US005626223A

United States Patent [19]

Lee

[11] Patent Number: 5,626,223

[45] Date of Patent: May 6, 1997

[54] CAM-ASSISTED SWITCH

[75] Inventor: James S. Lee, Niles, Ohio

[73] Assignee: Packard Hughes Interconnect Company, Irvine, Calif.

[21] Appl. No.: 673,585

[22] Filed: Jul. 1, 1996

[51] Int. Cl.[6] ..... H01H 3/02

[52] U.S. Cl. ..... 200/529; 200/533; 200/341

[58] Field of Search ..... 200/529, 526, 200/528, 533, 336, 341, 5 R, 512

[56] References Cited

U.S. PATENT DOCUMENTS

| | | | |
|---|---|---|---|
| 4,319,106 | 3/1982 | Armitage | 200/526 |
| 5,132,499 | 7/1992 | Valenzona et al. | 200/526 |
| 5,178,265 | 1/1993 | Sepke | 200/533 |
| 5,426,275 | 6/1995 | Maeda et al . | 200/553 |

*Primary Examiner*—David J. Walczak
*Attorney, Agent, or Firm*—Cary W. Brooks

[57] ABSTRACT

The present invention includes a cam-assisted switch. A keycap or button is provided with three or more cam contact points. A cam member is provided with an associated number of outwardly extending fingers corresponding to each cam contact point on the keycap. Each finger has a flat top surface, side surfaces and a slope surface extending from the top surface to a side surface. A base is provided with cam finger stops and a dome support point. A dome is carried on the dome support to bias the cam in one direction. As the keycap is depressed, the contact points each engage a sloped surface on one of the respective cam fingers. As the keycap is further depressed, the displacement of each keycap contact point is the same thus eliminating any wobble. When the operator releases the keycap, the dome biases the cam in the opposite direction returning the keycap to its original position.

3 Claims, 3 Drawing Sheets

CAM-ASSISTED SWITCH

FIELD OF THE INVENTION

This invention relates to electrical switches.

BACKGROUND OF THE INVENTION

Electrical switches having plunger buttons or large buttons are often unstable and wobble upon activation. This wobbling presents a poor quality of feel which is poor. In some automobile applications, large buttons are called for. Previously, rib and guide systems were used to minimize the wobble of large automotive buttons. The rib and guide system requires a length that is a function of the size of the button. Large buttons require long rib and guides, which thus requires a longer depth associated with the switch box. Sometimes depth length is constrained in automobile or other applications and therefore rib and guide systems cannot be used.

The present invention provides alternatives and advantages over the prior art.

SUMMARY OF THE INVENTION

The present invention includes a cam-assisted switch. A keycap or button is provided with three or more cam contact points. A cam member is provided with an associated number of outwardly extending fingers corresponding to each cam contact point on the keycap. Each finger has a flat top surface, side surfaces and a slope surface extending from the top surface to a side surface. A base is provided with cam finger stops and a dome support point. A dome is carried on the dome support to bias the cam in one direction. As the keycap is depressed, the contact points each engage a sloped surface on one of the respective cam fingers. As the keycap is further depressed, the displacement of each keycap contact point is the same thus eliminating any wobble. When the operator releases the keycap, the dome biases the cam in the opposite direction returning the keycap to its original position.

These and other objects, features and advantages will become apparent from the following brief description of the drawings, detailed description, and appended claims and drawings.

DETAILED DESCRIPTION

Figure 1:
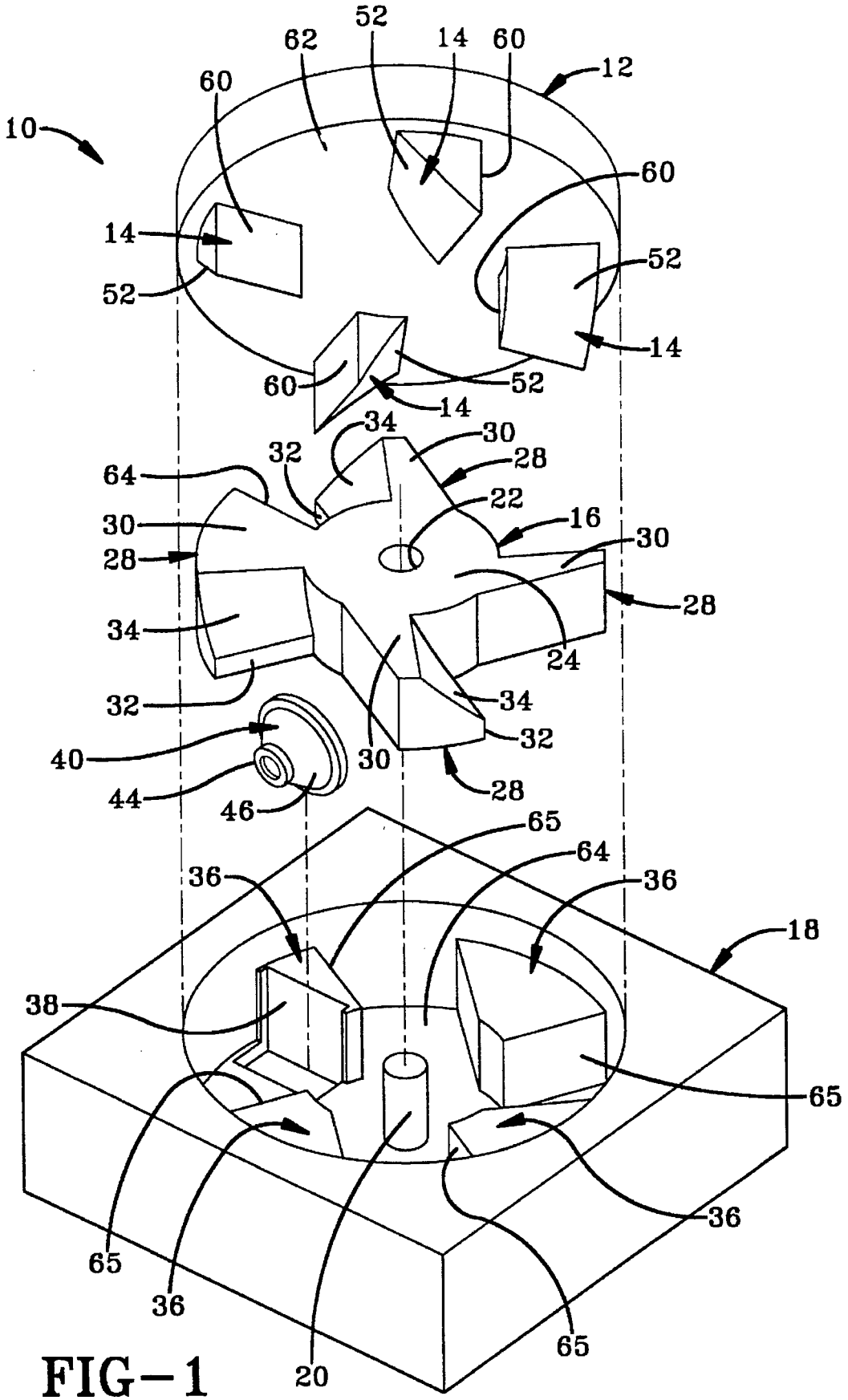
FIG. 1 is an exploded view of a cam-assisted switch according to the present invention.
Figure 2:
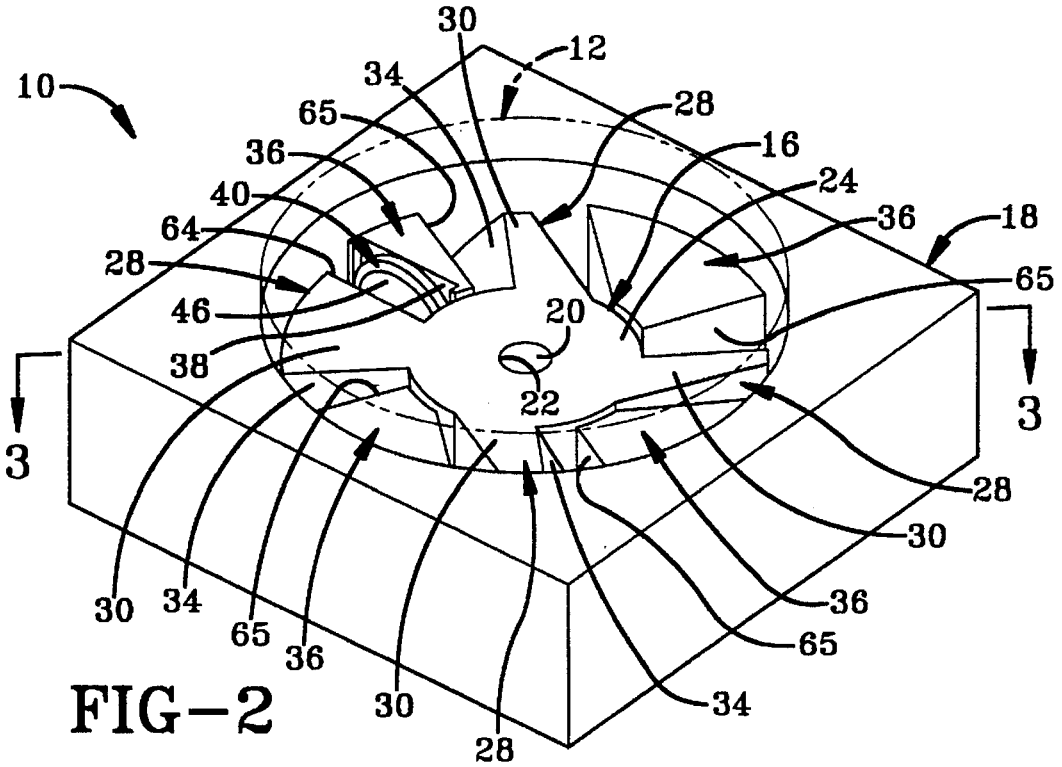
FIG. 2 is a perspective view of a cam, housing and resilient flexible dome sub-assembly according to the present invention.
Figure 3:
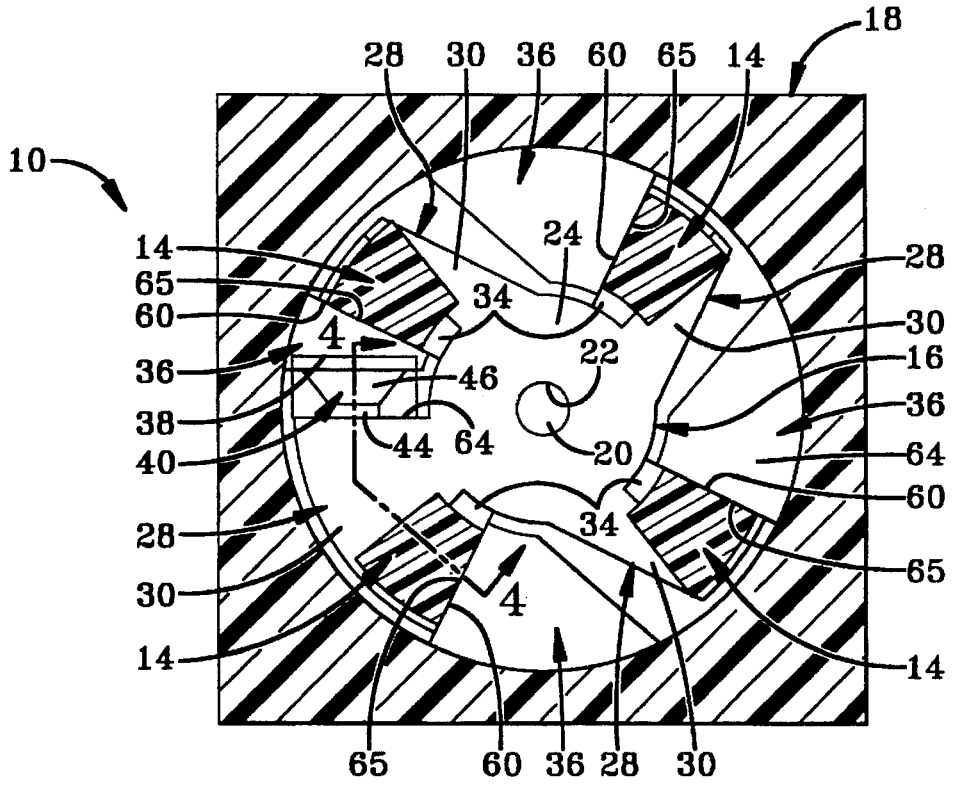
FIG. 3 is a sectional view taken along line 3—3 of FIG. 2.
Figure 4:
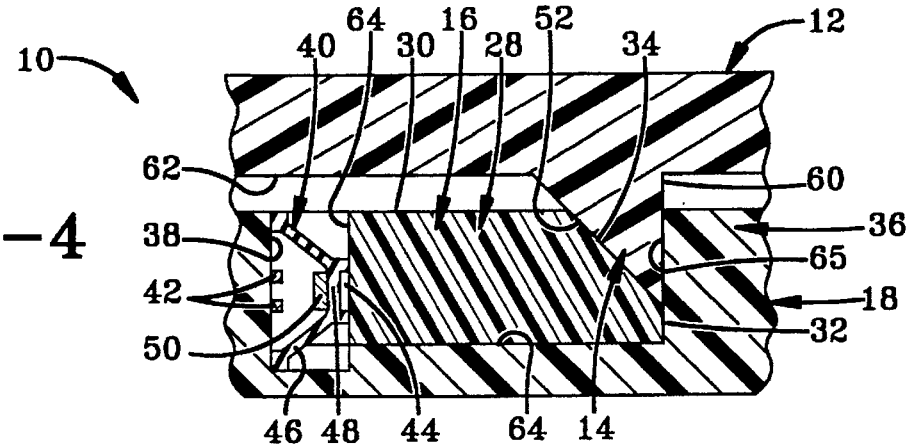
FIG. 4 is a sectional view taken along line 4—4.

The present invention is a cam-assisted switch 10 which includes a keycap 12 having cam contact points 14 such as downwardly extending legs which may be wedge-shaped. The cam 16 is provided for rotational movement on a support housing 18. preferably the support housing 18 has an upwardly extending rod 20 which is received in a hole 22 formed in the cam 16. The cam 16 includes a body portion 24 having the hole 22 formed therein to receive the rod 20. At least three spaced apart cam fingers 28 extend from the body portion. The cam fingers preferably include a flat top face 30 and downwardly extending side faces 32. The cam finger also includes a cam contact surface 34 which is sloped from the top flat surface 30. Preferably, the pitch of the sloped surface 30 of each cam fingers is the same.

The support housing has spaces formed therein to accommodate rotational movement of the cam and the cam fingers. The housing also provides a cam finger stop 36 associated with each cam finger. One of the stop fingers 36 of housing 18 includes a support point 38 for carrying a nonmetallic, flexible dome 40 positioned to bias one of the cam fingers against a finger stop 36 of the housing. Preferably the dome 40 is made from a silicone or other suitable elastomer.

In one embodiment of the invention the switch includes a stationary support 38 carrying a plurality of closely spaced contacts or ends of traces 42 of a printed circuit, a nonmetallic, flexible, preferably elastomeric, dome which is mounted on the stationary support or printed circuit which overlies the contacts or ends of the traces and an actuator for depressing the dome. The elastic dome has a resilient, annular outer ring 44 of a given thickness, and downwardly extending flexible side wall 46. A thinner membrane 48 underlies the annular ring and an electrically conductive pellet 50 is carried on the underside thereof. One of the fingers 28 includes a flat dome engagement surface 64 which constantly engages the annular ring 44 of the dome. As the keycap is depressed by an operator, the downwardly extending contacts 14 engage the slope surfaces 34 of the cam fingers causing the cam 16 as shown in FIG. 1 to rotate in a clockwise direction against the force of the dome 40. Preferably the keycap contacts 14 have a sloped cam contact surface 52 matching the sloped surface 34 of the cam fingers 28. Since sloped surfaces 34 of cam fingers 28 and cam contact surface 52 are complimentary to each other, the displacement of the cam fingers and the cam contact points is identical thus eliminating any wobbling of the keycap. Preferably the keycap contacts 14 also have a flat finger stop engagement surface 60 extending in a perpendicular direction from a bottom surface 62 of the keycap 12. The finger stop 36 extends perpendicularly from a floor 64 of the housing so that the flat finger stop engagement surface 60 slides along the finger stop surface stop 65 to stabilize the movement of the keycap and prevent wobble.

Figure 5:
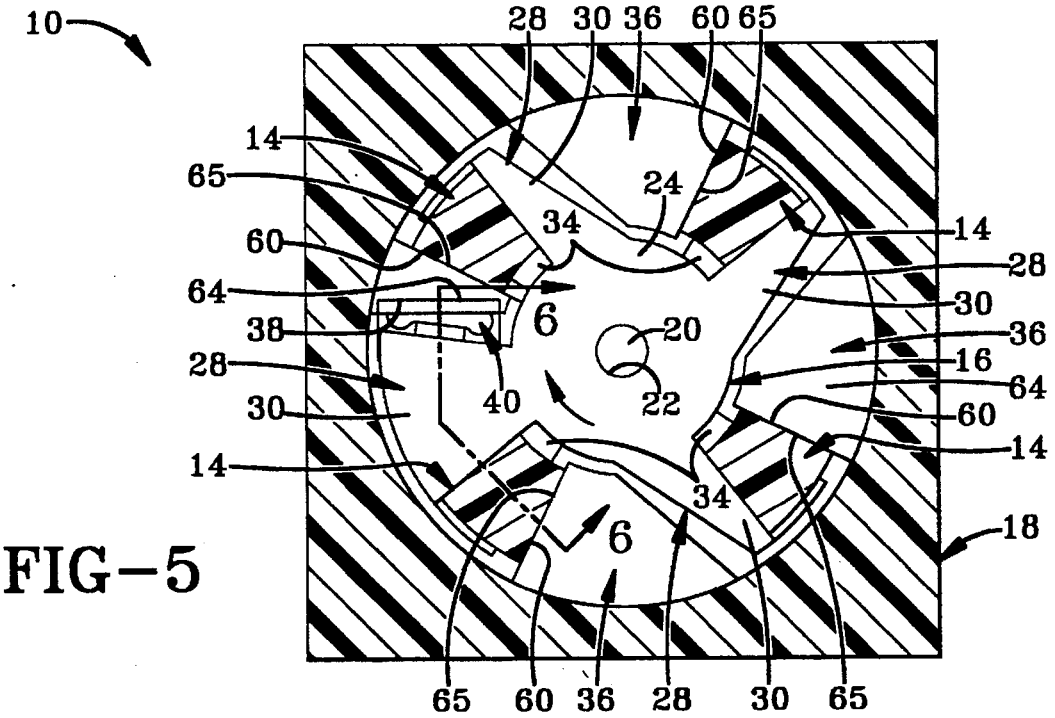
FIG. 5 is a view similar to FIG. 3 when the keycap is in a depressed position.
Figure 6:
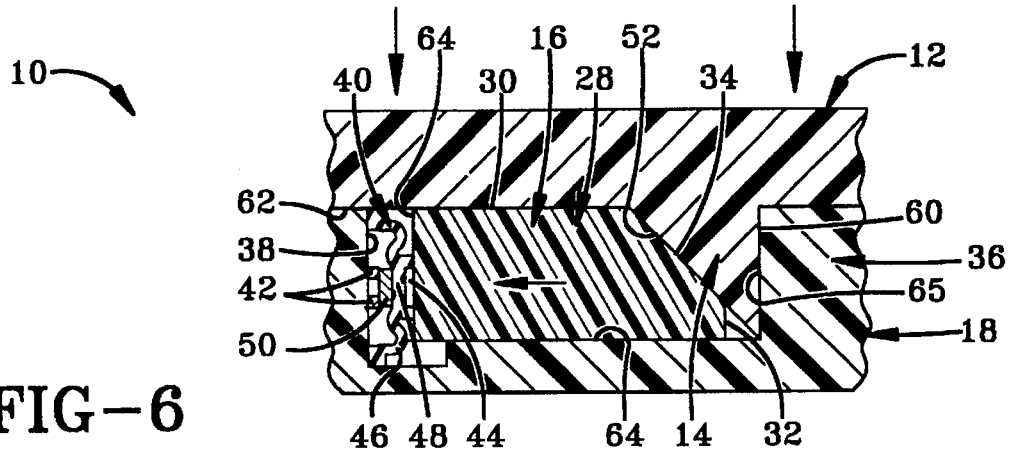
FIG. 6 is a sectional view taken along line 6—6 of FIG. 5.

As shown in the preferred embodiment of FIGS. 5–6, when the dome is depressed by the cam finger, the side walls 46 deflect outwardly to move the conductive element 50 on the thinner membrane 48 into engagement with the associated contacts or ends of the circuit traces 42 on the printed circuit thus closing the switch.

As will be appreciated, the cam-assisted switch can be constructed so that a contact point is provided anywhere with respect to any of the moving parts such as the keycap, cam fingers or dome to complete an electrical circuit and thus activate the switch.

What is claimed is:

1. A cam-assisted switch comprising:

a base having an electric circuit thereon, said circuit having spaced apart electrical contacts;

a cam having a body portion and at least three outwardly extending fingers, said cam overlying said base and constructed and arranged for rotational movement on said base; each of said cam fingers having a top surface and opposed downwardly extending side surfaces, and a sloped surface extending from the top surface downward towards the base, said sloped surface on each of said cam fingers being identically constructed;

a keycap having a contact point associated with each of said cam fingers constructed and arranged for engaging said sloped surface on said contact fingers;

said base having a stop associated with each cam finger for limiting the rotational movement of said cam in one direction;

a dome support surface connected to said base, and a nonmetallic, flexible, dome secured to said dome support and constructed and arranged to engage one of said cam fingers and biasing said finger in a first position against said stop and wherein said keycap is in a first position;

whereby said keycap is depressible so that each of said contact points moves downwardly along said sloped surface on said cam finger causing said cam to rotate in a first direction wherein said cam finger is in a second position displaced from said stop and said flexible dome is compressed, and upon release of said keycap said resilient dome biases said cam finger moving said finger back to said first position against said stop causing said contact points to move upwardly along said sloped surface and causing said keycap to return to said first position;

one of said keycap, cam, or dome having an electrical contact associated therewith for engaging said spaced apart electrical contacts and for closing said electrical circuit upon movement of said cam finger to said second position.

2. A cam-assisted switch as set forth in claim 1 wherein said contact points comprise downwardly extending pins.

3. A cam-assisted switch as set forth in claim 1 wherein said dome comprises a circular protrudence having collapsible side walls, terminating at a thickened ring, and a thinner membrane expanding an underside of the ring and carrying an electrically conductive pellet thereon.

* * * * *